United States Patent [19]

Melchior

[11] Patent Number: 4,854,280

[45] Date of Patent: Aug. 8, 1989

[54] TWO-STROKE INTERNAL COMBUSTION ENGINE AND CYLINDER HEAD FOR THE LATTER

[76] Inventor: Jean F. Melchior, 126 Bld du Montparnasse, 75014 Paris, France

[21] Appl. No.: 72,244

[22] PCT Filed: Dec. 31, 1986

[86] PCT No.: PCT/FR86/00451

§ 371 Date: Jul. 31, 1987

§ 102(e) Date: Jul. 31, 1987

[87] PCT Pub. No.: WO87/04217

PCT Pub. Date: Jul. 16, 1987

[30] Foreign Application Priority Data

Dec. 31, 1985 [FR] France ..... 85 19506

[51] Int. Cl.[4] ..... F02B 25/18

[52] U.S. Cl. ..... 123/257; 123/65 VD; 123/286

[58] Field of Search ..... 123/65 VD, 257, 286, 123/281, 283

[56] References Cited

U.S. PATENT DOCUMENTS

| | | | |
|---|---|---|---|
| 1,626,387 | 4/1927 | Burtnett | 123/65 VD |
| 2,061,157 | 11/1936 | Hurum | 123/65 VD |
| 2,222,134 | 11/1940 | Augustine | 123/65 VD |
| 2,685,869 | 8/1954 | Fenney et al. | 123/257 |
| 4,616,605 | 10/1986 | Kline | 123/65 VD |

FOREIGN PATENT DOCUMENTS

| | | | |
|---|---|---|---|
| 3143402 | 5/1983 | Fed. Rep. of Germany | 123/65 VD |
| 357519 | 9/1931 | United Kingdom | 123/65 VD |

*Primary Examiner*—Tony M. Argenbright

*Attorney, Agent, or Firm*—Larson & Taylor

[57] ABSTRACT

A two-stroke internal combustion engine, in particular of the diesel type, which comprises at least one intake valve (10) having its seat disposed in the wall of a combustion and scavenging prechamber (13) and at least one exhaust valve (7), is characterized in that the prechamber (13) communicates with the cylinder (1) through a transfer passageway (14) whose walls are at least partially substantially parallel to the axis (2) of the cylinder and whose cross-section perpendicular to this axis opens out in accordance with a substantially oblong shape tangent to the cylinder (1). An improved effectiveness of the engine is obtained.

24 Claims, 5 Drawing Sheets

TWO-STROKE INTERNAL COMBUSTION ENGINE AND CYLINDER HEAD FOR THE LATTER

The present invention generally relates to a two-stroke internal combustion engine having at least one cylinder containing a reciprocating piston, in particular but not exclusively of the diesel type, and it more particularly concerns a valve device exclusively incorporated in the cylinder head which permits the replacement of the burnt gases by fresh air required for the combustion.

The invention also relates to a cylinder head for internal combustion engines which is provided with said device and to the various applications and utilizations resulting from its use.

The replacement of the burnt gases by the charge of fresh air presents a particular problem in two-stroke internal combustion engines, since there is only a short period of time (corresponding to an angle of rotation of about 120° to 140° of the crankshaft) for achieving it, whereas, in four-stroke engines, the lapse of time available for this purpose is substantially longer and may correspond to an angle of rotation of about 400° of the crankshaft.

In two-stroke engines having modern valves, one tries to improve the scavenging:

(a) by increasing the permeability of the work chamber or cylinder when the intake and exhaust valves are simultaneously open;

(b) by decreasing the short-circuit between the intake and the exhaust by means of the orientation of the current of particles of fresh air entering the cylinder, in a direction which prevents them from passing directly from the intake to the exhaust, (c) by reducing as far as possible the mixture, in the cylinder, between the fresh air and the burnt gases coming from the preceding cycle or cycles.

In U.S. Pat. No. 2,061,157 (Hurum), it has already been proposed to dispose, in the cylinder head of a two-stroke internal combustion engine, one or two intake valves which open onto a prechamber of flat shape and whose axis or axes are orthogonal to the axis of the cylinder, and an exhaust valve whose axis is parallel to that of the cylinder and offset relative to the last-mentioned axis. The prechamber communicates with the cylinder through an orifice of restricted section so as to cause the mixture of air and fuel to enter the cylinder in the form of a compact jet and the stem of the or each intake valve extends through the space defined in the cylinder head by the geometrical extension of the wall of the cylinder, which gives rise to a throttled and dissymmetrical flow of the mixture into the cylinder. Experience has shown that said compact jet was not very effective from the scavenging point of view: indeed, if the criterion (b) is respected, owing to the introduction at high velocity of particles of air in the cylinder toward the piston, on the other hand, the criterion (c) is not respected: the introduction of particles of air at high velocity in the cylinder is effected, owing to the disposition of the intake valve, in the very midst of the gas mass—particularly at the moment when the intake valve is at the beginning of the opening—and creates an intense mixture of the fresh air and burnt gases. Further, this disposition leaves dead regions which are not scavenged, which still further reduces the scavenging effectiveness. Owing to the presence of the orifice of restricted section, the permeability of the cylinder head to the flow (criterion a) is very poor. Lastly, the flat shape of the prechamber results in a bad mixture between the fresh air and the fuel which is injected thereinto. This analysis of U.S. Pat. No. 2,061,157 is confirmed in the third paragraph of U.S. Pat. No. 4,616,605 (Kline) which was only published on Oct. 14, 1986.

In U.S. Pat. No. 2,222,134 (Augustine) there is described a two-stroke internal combustion engine having an intake and an exhaust valve whose axes are parallel to that of the cylinder and whose opening movements are in opposite directions The seat of the intake valve opens upwardly onto the prechamber which opens downwardly onto the cylinder through an orifice in the shape of a crescent disposed tangentially to the cylinder. The geometry of the prechamber is such that a high turbulence occurs around the intake valve and causes a disorientation of the particles of fresh air entering the cylinder, producing a large short circuit (criterion b) not respected) and that the air is preferentially directed into the extrados of the elbow connecting the prechamber to the cylinder, which will cause the particles of air to enter in the very midst of the gas mass, resulting in a large mixture of fresh air with the burnt gases (criterion c) not respected).

An object of the invention is to improve the operation of a two-stroke internal combustion engine, in particular but not exclusively of the diesel type, having at least one cylinder with a reciprocating piston and a device for exchanging the gases which is achieved exclusively by at least one intake valve and at least one exhaust valve disposed in the cylinder head at the top of the associated cylinder, so as to obtain a scavenging which respects all three criteria defined above.

The invention has therefore principally for an object, in an engine of the aforementioned type, to increase the effectiveness of the exchange of the gases, i.e. to expel as far as possible the residual burnt gases from the cylinder by replacing them by a corresponding volume of fresh air, while preventing or at least reducing as far as possible any risk of a direct passage of the fresh air from the intake valve to the exhaust valve and simultaneously avoiding as far as possible any creation of a region of a mixture of fresh air and burnt gases, with a minimum expenditure of energy. The expense of energy is minimized by the search for the best possible utilization of the scavenging air supplied to the cylinder, as described before, but also by the obtainment of greater permeability, i.e. by the realization of maximum flow sections offered to the gaseous fluids thus requiring a minimum pressure difference between the pressure of scavenging air and the back-pressure in the exhaust to ensure a given scavenging air flow. The effectiveness of the exchange of the gases of the two-stroke internal combustion engine is thus characterized by the quality of the utilization of the scavenging air, on one hand, and by the permeability of the cylinder on the other. These two characteristics directly condition the power and the efficiency of the cycle of the diesel engine which is not supercharged and also, but to a lesser degree, of the diesel engine which is moderately or highly supercharged.

All the observations made before for diesel engines apply to engines which have a controlled ignition or a natural aspiration or are supercharged.

In the case where, for these engines, the preparation of the preferably homogeneous mixture of air and fuel is effected upstream of the cylinder by means of a carburetor or a fuel-injection system, it becomes necessary to obtain an exchange of the gases without a short-circuit of carburetted fresh air to the exhaust. In two-stroke engines having a loop scavenging through intake and exhaust ports, it is thus conventional to undergo losses of air, and therefore fuel, of up to 30% and even 40% of the fresh charge retained in the cylinder in the course of the exchange of the gases, which has a correspondingly adverse effect on the fuel consumption. The geometry of the structure must moreover permit a satisfactory combustion, which is in practice manifested by the necessity of simultaneously satisfying antagonistic conditions or requirements. The object of the invention is therefore to realize a compromise between a good efficiency of the scavenging and of the combustion with the simplest technology while as far as possible retaining the aforementioned advantages and reducing the previously-mentioned drawbacks.

In order to facilitate the following description, it will be assumed that the position of the cylinder is such that its axis is vertical and that the cylinder head occupies the upper or top position and the piston the lower or bottom position.

The present invention solves the aforementioned technical problems by providing a two-stroke internal combustion engine having at least one cylinder with a reciprocating piston and a device for exchanging gases entirely incorporated in the cylinder head and comprising a group of at least one intake valve and a group of at least one exhaust valve, each intake valve having its seat disposed in the wall of a combustion and scavenging prechamber, said device exchanging the gases having a plane of symmetry passing through the axis of the cylinder and common to the disposition of the group of at least one intake valve, to the disposition of the group of at least one exhaust valve, and to the configuration of the interior surface of the prechamber and of the roof of the cylinder head and to the configuration of the surface of the piston, characterized in that the prechamber communicates with the cylinder through a transfer passageway whose walls are at least partly substantially parallel to the axis of the cylinder and whose cross section perpendicular to this axis opens, according to a substantially oblong shape tangential to the cylinder, and the or each intake valve cooperates with the lateral wall of the prechamber practically without clearance with the latter in the upper part of said valve so that the circuit of intake air, upstream of the valve, opens directly onto the transfer passageway downstream of the valve, including during the first instants of the rising of the valve.

According to another characteristic of the invention, the axis of each intake valve has a direction which is not parallel to the direction of the axis of the cylinder and makes with the latter an angle preferably between about 45° and about 90°.

According to yet another feature of the invention, the seat associated with each intake valve is located in a wall portion of the prechamber extending at least approximately the wall portion of the transfer passageway tangent to the surface of the cylinder.

According to a first embodiment, a single intake valve and a single exhaust valve are provided.

According to a particular embodiment, the gas exchange device has two intake valves parallel to each other.

According to another particular embodiment, the gas exchange device has two exhaust valves parallel to the axis of the cylinder. According to another characteristic of the invention, the engine is characterised in that the cross section of the passageway opening onto the cylinder is developed in a circular sector having an angle subtended at the centre of between 60° and 110° and represents an area representing a ratio relative to that of the cross section of the cylinder of preferably between 0.10 and 0.20 and more particularly between 0.13 and 0.17.

According to another embodiment of the invention, the bottom wall of the scavenging and combustion prechamber substantially opposed to the transfer passageway opening onto the cylinder is constituted by a portion of a cylinder of revolution coaxial with each intake valve, substantially tangent to each valve head, so that the radial clearance between said wall and the head of each intake valve has a minimum value which is such that each intake valve discharges directly and essentially on its sector oriented in the direction of the transfer passageway so as to orient the quasi-totality of the air flow issuing from each intake valve directly toward the transfer passageway.

According to yet another embodiment of the invention, the engine is characterized in that the radial clearance is as small as possible between the upper part of each intake valve and the lateral and cylindrical wall coaxial with the corresponding valve, of the prechamber in the angular sector substantially opposed to the transfer passageway.

According to another of its aspects, the invention also concerns a cylinder head of two-stroke internal combustion engines arranged in accordance with the previously-explained characteristics.

The invention affords, among others, the following important advantages:

It permits rendering the sections of the intake and exhaust valves maximum while requiring only a relatively slight deviation of the mean stream of air during its passage from the intake manifold to the interior of the cylinder, which results in a substantially increased permeability as compared with other solutions employing the same number of intake and exhaust valves.

The scavenging effectiveness is improved, since it permits, while ensuring a high permeability, the obtainment of a high scavenging efficiency with a very good utilization of the scavenging air, while reducing as far as possible any risk of a direct passage of fresh air from the cylinder to the exhaust valve, owing to the confinement of the stream which is accelerated toward the piston without being able to deviate in the direction of the exhaust valve, including during the first instants of the opening of the intake valve.

The experimental development for the obtainment of a good scavenging effectiveness is considerably simplified owing to the small number of parameters governing the formation of the air stream. Indeed, for the first part of the rising of the valve, and therefore at a low scavenging flow, the shape of the walls defining the prechamber and leading to the transfer passageway is preponderant for the orientation of the air stream onto the wall of the liner which is the most remote from the exhaust valve while with increasing rise and high scavenging flow, this function is performed in major part by the shape of the tulip of the intake valve and of the associated seat, enabling the flow to effect a bend at about 90° between the intake pipe and the cylinder with a minimum of throttling after the passage through the neck.

Apart from the obvious constructional simplification afforded by the invention in the variant using only a single intake valve, a single intake valve forbids any dissymmetry of the scavenging air stream relative to its previously defined plane of symmetry, which is always difficult to avoid when there are for example two intake valves owing to a possible evolution in operation of their respective clearance or of their respective soiled state. The important participation of the geometry of the transfer passageway, which represents a fixed geometry as opposed to the essentially variable geometry of the intake valve, in the formation of the scavenging air stream, permits the realization of a scavenging air stream of great stability in all cases of load and running speed of the engine. The transfer passageway contributes, as the case may be, to the re-establishment of an improved symmetry of the gaseous stream.

The invention ensures a successive scavenging of the prechamber and the cylinder so that, even in the case of a very small quantity of scavenging air, the volume of the prechamber is scavenged and filled almost exclusively with fresh air before the compression stroke (as opposed to nonscavenged combustion prechambers). This has for consequence that, in the described extreme case corresponding to operation with a partial load, the volume of comburent air is in the upper part of the prechamber after having been urged back by the residual gases coming from the cylinder during the compression stroke.

There are thus created, somewhat by a stratification effect, conditions which are to be very advantageously exploited for controlling the operation of the engine under minimum load, whether it concerns an engine having a compression ignition or an engine having a controlled ignition. In both cases, the means for introducing fuel (injector) and/or for ignition will be preferably placed in the part of the prechamber opposed to the seat of the intake valve.

The movement of the piston at the end of the rising travel of the latter, i.e. in the vicinity of its upper dead centre, causes the transfer of the charge of fresh air from the cylinder to the prechamber and thus creates a field of turbulence which is all the more intense as the dead space is small between the head of the piston, which is preferably flat, and the inner end of the cylinder head where the head of the exhaust valve is flush in the closed state.

The turbulence prevailing in the combustion prechamber at the moment of the injection of the fuel, in the period immediately preceding the upper dead centre position of the piston, may be strongly influenced by the residual turbulence of the vortex issuing from the scavenging phase in the direction opposed to the turbulence field created by the rising of the piston.

The fact that the combustion and scavenging prechamber is both scavenged and cooled by the scavenging air and the major part of the heat given off in the course of the combustion phase occurs in said prechamber, permits containing the thermal charge of the cylinder head and of the upper part of the cylinder while equalizing the highest temperatures of the constituent parts of the cylinder head and of the cylinder exposed to the combustion gases. This advantage is preponderant for a two-stroke engine in which it is well known that the thermal charge is higher than in the case of a four-stroke engine and this, more particularly in respect of engines employing very high maximum cycle pressures (for example on the order of 200 to 300 bars) as envisaged within the scope of the invention.

The disposition and the size of the intake and exhaust valves permit the use of the inside of their seats for providing in the known manner an annular cooling passageway to ensure the cooling of said valves but also that of the cylinder head proper, owing to the very large fraction of the surface of the cylinder head in contact with the combustion gases which are thus naturally irrigated by the cooling water of said valve seats.

The horizontal or inclined disposition of the intake valve permits the actuation thereof by a very direct drive, in particular by a lateral camshaft disposed in the upper part of the engine block, in the case of multicylinder engines provided with individual cylinder heads, or by an overhead camshaft in the case of engines having a single cylinder head. This configuration permits, owing to the small masses in motion, the realization of very high acceleration values when the intake valve is opened and closed, without exceeding the allowable limits of contact pressure in the region of the cam, which is very favorable since the opening diagram of the intake valve is very short (on the order of 100° to 140° of rotation of the crankshaft) and shorter than that of the exhaust valve (on the order of 20° to 40° of rotation of the crankshaft). This disposition favours the realization of intake valve rises which are greater than that which is conventional in known engines (the ratio between the maximum rise and the inside diameter of the seat of the valve may reach and exceed twice the normal ratio) for compensating the fact that the intake valve only discharges in its lower part bearing in mind its practically zero radial clearance in its upper part, with the lateral surface of the prechamber opposed to the transfer passageway.

This permits an elegant solution of the aforementioned problem presented by the very short period of opening of the valves and in particular the intake valves.

All of the advantages described hereinbefore and principally relating to the effectiveness of the scavenging and of the combustion permit the realization of an excellent scavenging and combustion efficiency up to high values of the stroke/bore ratio of the cylinder, in particular higher than the values known elsewhere for scavenging in a loop or in a corner achieved by means of ports disposed in the liner or exclusively by means of valves disposed in the cylinder head. The obtainment of a good scavenging efficiency with a very high stroke/-bore ratio (up to 2 and even 2.5) is in keeping in a very favorable manner with the actual technical evolution of large-bore diesel engines for naval or ground applications, since the search for the highest efficiency today results in the use of ever-increasing stroke/bore ratios (making it possible to obtain a high volumetric compression ratio and a high combustion efficiency) on the order of 3 to 4 for slow two-stroke engines having a unicurrent scavenging and a cross construction and 1.5 to 2 for semi-rapid four-stoke engines in both cases to the detriment of the weight and the overall size. This characteristic indeed permits the contemplation of the application of the device according to the invention to semi-rapid two-stroke engines having a scavenging exclusively through the cylinder head, which, owing to the known advantages of the two-stroke cycle as concerns specific power, would contribute for these high efficiency engines, which are however of increasingly large size, to a substantial improvement in the weight/- power ratio (on the order of 30% for an unchanged efficiency)

Lastly, the geometrical configuration of the scavenging and combustion prechamber provides very high volumetric ratios which may reach and even exceed 20, this being true also in the case of stroke/bore ratios close to unity. This fact facilitates the starting up conditions of diesel engines of very small size, for example, in the automobile application.

A better understanding of the invention will be had and other objects, characteristics, details and advantages thereof will appear more clearly in the course of the following description with reference to the accompanying diagrammatic drawings, in which:

FIG. 1 is a fragmentary view, in cross-section, only of the elements relating to the invention, i.e. of the head of a cylinder and of the associated cylinder head portion of a two-stroke diesel engine having a distribution through an intake valve and an exhaust valve which are perpendicular to each other and are both represented open during the scavenging and filling stage in the vicinity of the bottom dead centre of the piston;

Figure 1:
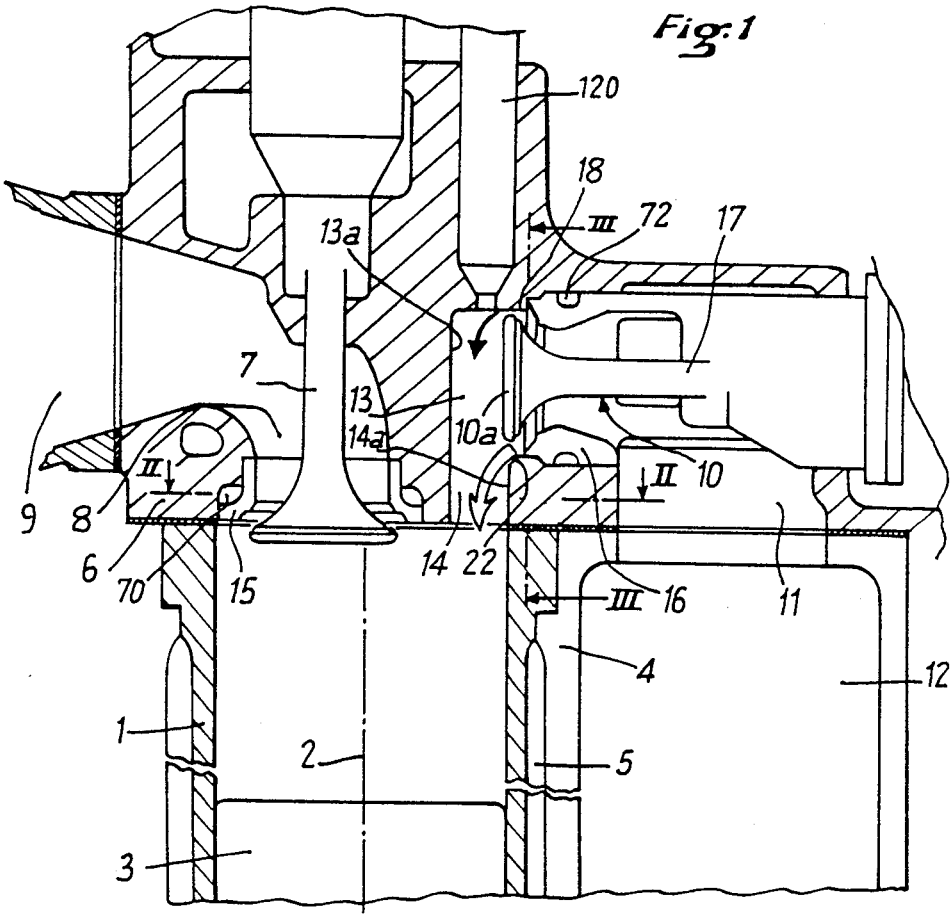
Figure 2:
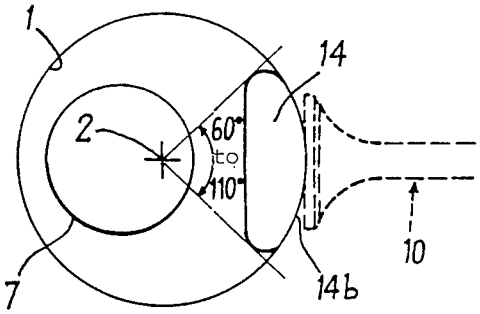
FIG. 2 is a horizontal cross-sectional view taken on line II—II of FIG. 1, showing the opening of the transfer passageway onto the cylinder.
Figure 10:
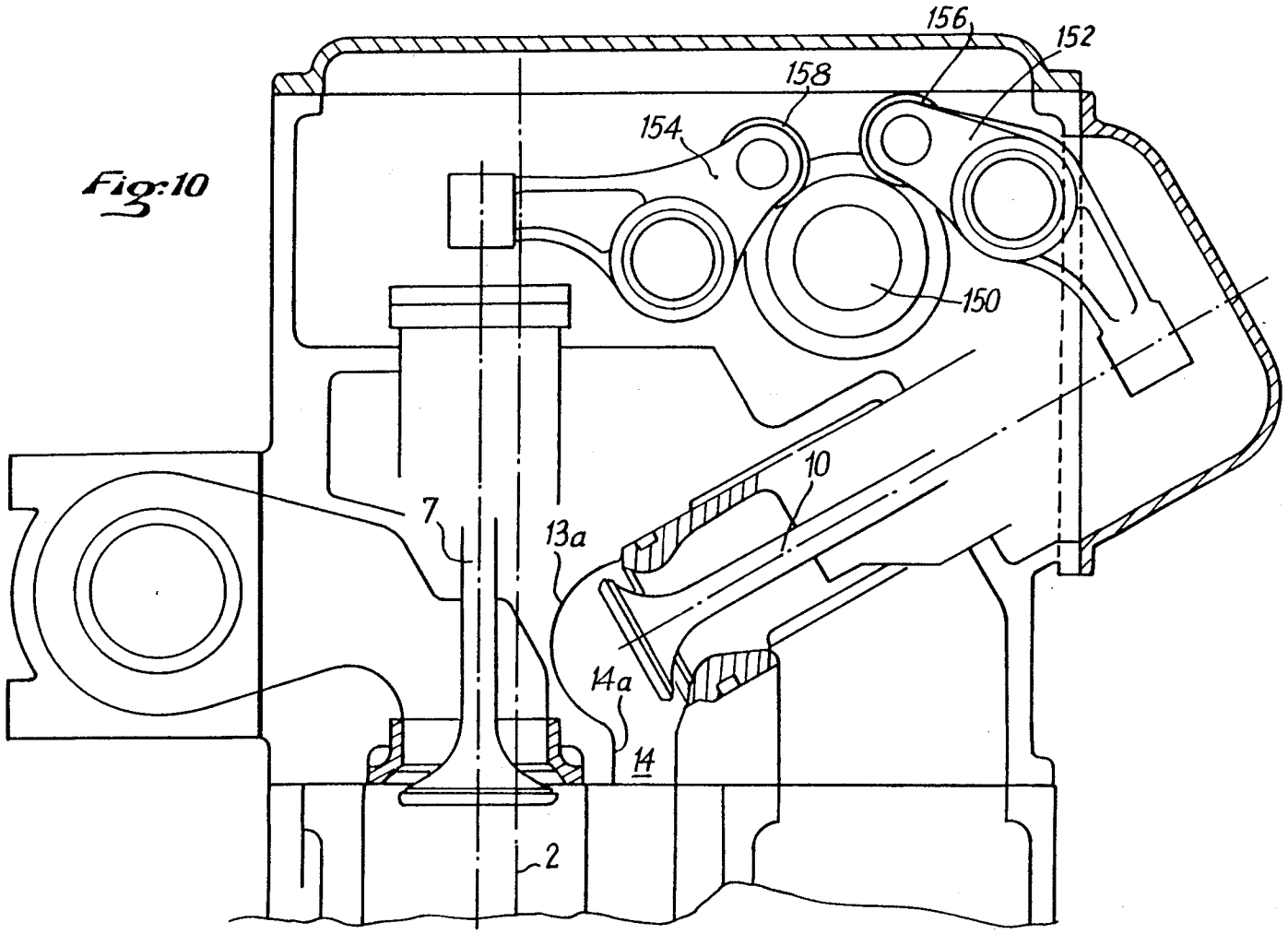

FIGS. 9*a* to 9*h* represent the different phases of the cycle of operation of the variant represented in FIGS. 1 and 2;

FIG. 10 represents another embodiment of the invention in a fragmentary view similar to that of FIG. 1, in which the control of the valves by a single common overhead camshaft is clearly shown.

According to the embodiment shown in FIG. 1, the reference 1 designates a cylinder of a diesel engine having one or more cylinders operating in accordance with a two-stroke cycle, having a geometric axis 2 here represented in a substantially vertical position and containing a reciprocating piston 3 represented in a position close to its bottom dead center.

This cylinder 1, here for example constituted by a wet liner type, is mounted in the cylinder frame or block 4 of the engine and usually surrounded by a cooling water jacket 5. The upper end or head of the cylinder is surmounted and closed by a cylinder head 6 which contains an exhaust valve 7 controlling an exhaust pipe 8 for the burnt gases communicating with an exhaust line 9 forming in particular an exhaust manifold, and an intake valve 10 controlling an intake pipe 11 for fresh comburent air communicating with an intake manifold 12. The intake valve 10 and the intake pipe 11 open on to, in the direction of flow of the fresh scavenging air, a scavenging and combustion prechamber 13 which is formed in the cylinder head 6 and opens on to the cylinder 1 by communicating with the latter through a transfer passageway 14. The disposition of the intake valve 10 and exhaust valve 7 preferably allows a plane of symmetry moreover corresponding to the plane of FIG. 1 and containing the axis of the exhaust valve 7, the axis of the intake valve 10 and the axis 2 of the cylinder 1, the axis 2 being shown in dot-dash line in FIG. 1.

The axis of the exhaust valve 7 is substantially parallel to the axis 2 of the cylinder and offset from the latter so that, in the open position, the head of this exhaust valve 7 is located on one side (on the left side of FIG. 1) relatively close to the corresponding neighbouring lateral wall of the cylinder 1 and on the other side (on the right side of FIG. 1) relatively remote from the opening out of the transfer passageway 14.

The axis of the intake valve 10 opening on to the prechamber 13 is not parallel and is here represented preferably at least orthogonal to the walls of the cylinder 1 and therefore to the axis of the exhaust valve 7 and to the axis 2 of the cylinder. As is clear from FIG. 1, the stem 17 of the valve 10 extends away from this axis 2 in said plane of symmetry.

The exhaust valve 7 cooperates with a fixed seat 15 provided in the cylinder head 6. Likewise, the intake valve 10 cooperates with a fixed seat 16 provided in the cylinder head 6.

The transfer passageway 14 has a wall 14*a* at least partly substantially parallel to the axis 2 of the cylinder 1, the part 14*b* of the wall located adjacent to the intake valve 10 in fact constituting an extension of the wall of the cylinder 1 (see FIG. 2). The opposite part of the wall 14*a* of the transfer passageway 14 in fact also constitutes an extension of the part of the wall 13*a* of the premixture chamber 13 opposed to the intake valve 10. The transfer passageway 14 moreover has in cross-section perpendicular to the axis 2 of the cylinder 1, a substantially oblong shape tangent to the cylinder 1, as is clearly shown in FIG. 2. The cross-section of the transfer passageway 14 opening on to the cylinder 1 is preferably developed on a circular sector having an angle subtended at the centre of between 60° and 110° and represents an area whose ratio relative to that of the cross-section of the cylinder 1 is preferably between 0.10 and 0.20 and, more particularly, between 0.13 and 0.17.

In its upper part, the prechamber 13 has, from the seat 16 of the intake valve 10, a cylindrical portion of revolution 18 coaxial with the intake valve 10, substantially tangent to the head 10*a* of the valve 10 and having such dimension that there is practically no air flow in the upper part of the head 10*a* of the intake valve 10. This cylindrical portion 18 therefore constitutes in practice the top or the end wall of the prechamber 13.

Further, the wall part 14*a* of the transfer passageway 14 is connected to the lower part of the valve seat 16 by an arcuate profile 22 permitting a direct flow of air to the transfer passageway 14 from the start of the opening of the intake valve 10.

Figure 3:
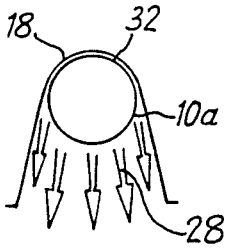
FIG. 3 is a sectional view taken on line III—III of FIG. 1.

As is clear in particular from FIG. 3, the cylindrical part of revolution 18 substantially coaxial with the intake valve 10 leaves between this wall 18 and the head 10*a* of the intake valve 10 a radial clearance 32 having a minimum value preventing the creation of a significant air stream around the upper part of the head 10*a* of the intake valve 10. Consequently, the quasi-totality of the air flow issuing from the intake valve 10 flows around the lower part of the head 10*a* of the intake valve 10 to the transfer passageway 14, as symbolically represented by the flow arrows 28 of FIG. 3.

Figure 4:
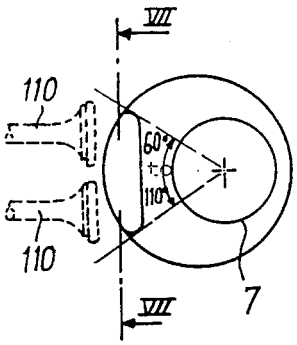
FIG. 4 is a sectional view similar to that of FIG. 2 of an embodiment having two intake valves which are parallel to each other.
Figure 7:
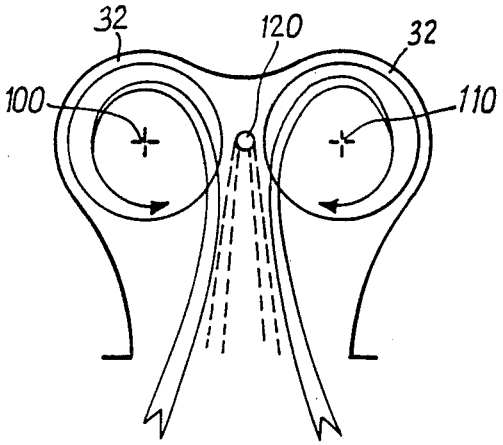
FIG. 7 is a sectional view taken on line VII—VII of FIG. 4.

With reference to FIG. 4, a second embodiment of the invention has been shown according to which two intake valves are provided respectively designated by 100 and 110, in the upper part of each of which there is provided, as in the case of FIG. 3, a minimum radial clearance 32 which is just sufficient for the passage of the heads of these valves. As shown in FIG. 7, this permits the injection of fuel in the aforementioned plane of symmetry and also, as will be explained hereinafter, deriving benefit from the organized turbulence produced by the flow from the cylinder 1 resulting from the rising of the piston. In this embodiment, a single exhaust valve 7 is provided.

Figure 5:
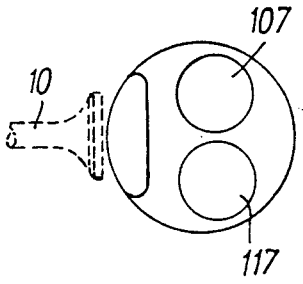
FIG. 5 is a sectional view similar to that of FIG. 2 of an embodiment having two exhaust valves parallel to each other.

With reference to FIG. 5, there has further been shown an embodiment of the invention in which two exhaust valves designated respectively 107 and 117 are provided, with a single intake valve 10.

In each of these embodiments of FIGS. 4 and 5, the single valve, namely the exhaust valve 7 or the intake valve 10, is in the aforementioned plane of symmetry.

Figure 8:
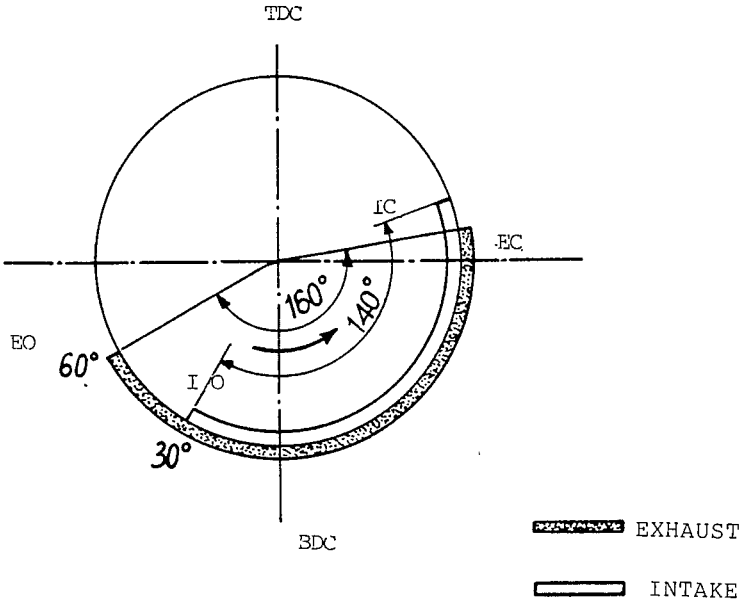
FIG. 8 represents the diagram of the opening periods of the intake and exhaust valves as a function of the angle of rotation of the crankshaft.

FIG. 8 represents the opening diagram of the intake and exhaust valves of the preferred embodiment of FIGS. 1, 2 and 3. In the usual manner, the intake opening is designated 10, the exhaust opening is designated EO, the intake closure IC, the exhaust closure EC, the top dead centre TDC and the bottom dead centre BDC.

The opening period of the exhaust valve 7 represents about 160° of the angle of rotation of the crankshaft, while the open period of the intake valve 10 represents about 140° of the angle of rotation of the crankshaft. It will be observed in this respect that the opening period of the exhaust valve 7 starts well before the opening period of the intake valve 10, respectively 60° and 30° before the bottom dead centre.

With reference to FIGS. 9*a* to 9*h*, different sequences of the cycle of operation of this engine have been shown.

Figure 9:
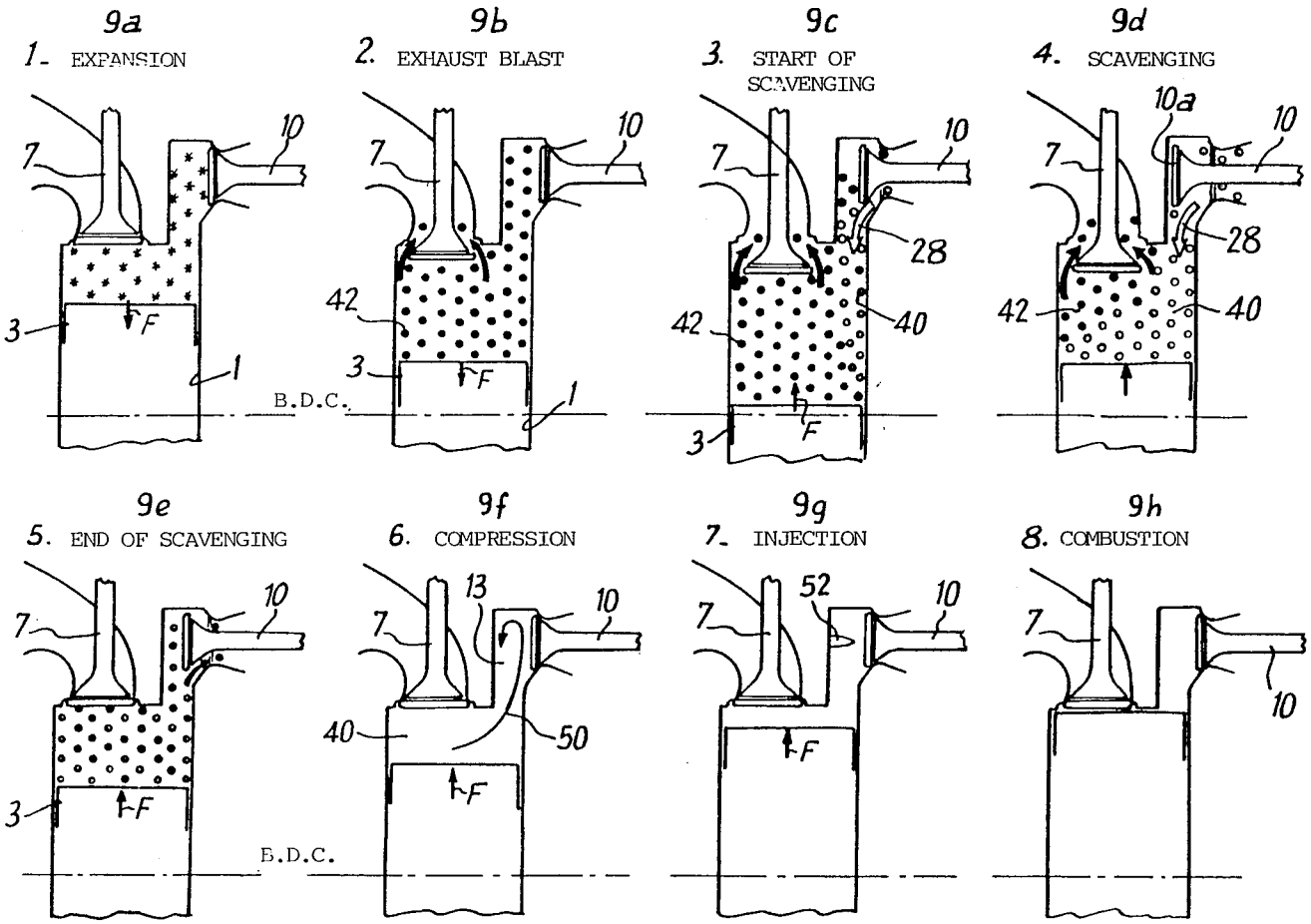

FIG. 9*a* represents the expansion phase in respect of which the intake valve 10 and the exhaust valve 7 are closed and the piston 3 travels toward the bottom dead centre as represented symbolically by the arrow F.

FIG. 9*b* represents the following sequence in respect of which the exhaust valve 7 has just opened while the intake valve 10 is still closed, the piston 3 continuing its downward movement toward the bottom dead centre, which will permit, as known per se, the lowering of the pressure in the cylinder 1 to the level of the scavenging pressure.

FIG. 9*c* represents the following sequence in respect of which the exhaust valve 7 is roughly completely open, the piston being at the beginning of its upward stroke as shown by the inverted direction of arrow F, while the intake valve 10 is already practically open and thus permits the flow of the air stream which has been designated for example by 28 in FIG. 3.

This flow 28 is converted into a single air flow 40 bearing against the vertical wall of the cylinder following on the transfer passageway 14 which discharges, as it enters the cylinder 1, a corresponding volume of burnt gases 42.

FIG. 9*d* represents the following sequence corresponding to the scavenging of the cylinder 1 and showing the maximum rises of the exhaust valve 7 and the intake valve 10 respectively. Note in this respect that this maximum rise of the intake valve 10 is greater than that of usual two-stroke engines. As indeed is known, the rise of a valve is so calculated that the lateral area of the geometric cylinder limited between the valve seat and the transverse surface of the valve is equal to or slightly greater than the free section of the open valve seat. In the case of the invention, it is only about one half of the lateral area of said geometric cylinder which allows the passage of the fresh air, and it is consequently necessary to compensate for this loss of area by increasing the rise of the intake valve 10 or of the intake valves 100, 110. For this purpose, preferably the ratio between the maximum rise of the or each intake valve 10 and the inside diameter of the seat 16 of said intake valve exceeds 0.35.

It will be observed that, at this moment of the cycle, the intake air flow 40, which is practically without mixture with the burnt gases 42 and is almost exclusively supplied by the stream 28 owing to the position of the head 10*a* of the intake valve 10, occupies almost the whole of the volume of the cylinder 1 and has urged back the major part of the burnt gases 42.

FIG. 9*e* represents the sequence of the end of the scavenging for which the exhaust valve 7 has just closed, the intake valve 10 being partly open before its complete closure. The piston 3 continues its upward travel in the cylinder 1 and urges back a part of the air in the direction of the intake manifold 12.

FIG. 9*f* represents the following compression sequence for which the two valves, namely the exhaust valve 7 and the intake valve 10, are closed. The continued upward travel of the piston in the cylinder therefore not only produces the compression but also a progressive discharge of air to the prechamber 13, which results in a large turbulence field. symbolically represented by the arrow 50, suitable for the fuel injection phase and the mixture of the fuel with the comburent air in the following sequence.

FIG. 9*g* represents the fuel injection phase just before the top dead centre, symbolically represented by a fuel jet 52.

Lastly, FIG. 9*h* represents the last sequence relating to the combustion of the mixture thus prepared with the piston at its top dead centre. Owing to the described structure and to this operation, all the technical advantages mentioned in the introduction part of the description are obtained.

Moreover, it will be understood that various modifications may be made without however departing from the scope of the invention. The invention therefore comprises all the means constituting technical equivalents of the described means and their various combinations.

In particular, any usual means may be used in combination with the means of the invention, whether this concerns the rocker arms, the design of the injection and of the combustion chamber, the design of the structure of the cylinder head which may be advantageously of the type known per se having bored passageways. Moreover, in FIG. 1, there have been designated by 70, 72 passageways for cooling the seats 15, 16 of the exhaust valve 7 and intake valve 10, which permits a cooling not only of the valves themselves but also of the major part of the cylinder head 6 exposed to the combustion gases.

It has been seen in this respect in the introduction part of the description that it was possible to almost completely avoid the presence of water chambers by imparting in this way to the cylinder head a very high structural rigidity.

Further, according to another embodiment shown in FIG. 10 similar to that of FIG. 1 and in respect of which the same reference characters have been used for identical parts, it may be arranged that the direction of the axis of the intake valve 10 make an angle equal to about 50° with the direction of the axis 2 of the cylinder 1. In this case, there may be realized advantageously a control of each group of at least one intake valve 10 and of each group of at least one exhaust valve 7 by a single common overhead camshaft 150 acting on each aforementioned valve through associated rocker arms 152, 154 provided with rollers 156, 158, the valve-return means having been omitted in order to render the drawing more understandable.

Figure 6:
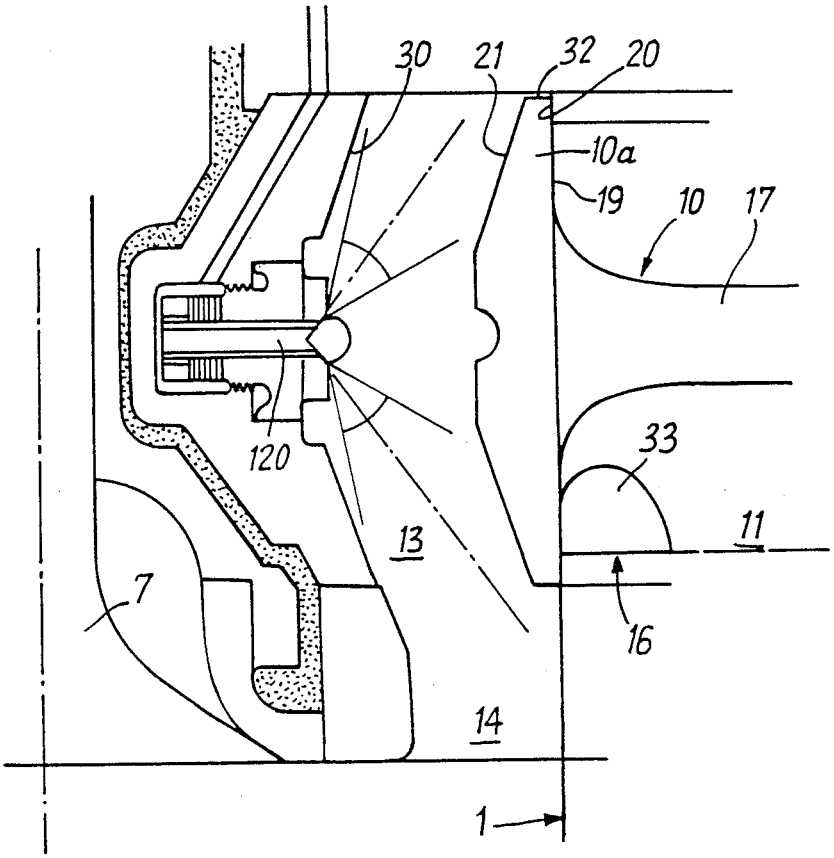
FIG. 6 represents, to an enlarged scale, a preferred variant of the embodiment of FIGS. 1 to 3.

According to the variant of FIG. 6, the head 10*a* of the intake valve 10 has an approximately planar surface 19 adapted to cooperate with a conjugate surface 20, also approximately planar, of the seat 16. The opposite side 21 of the head 10*a*, which is preferably approximately conical, is so arranged as to enter a cavity 30 of conjugate shape provided in the opposite wall of the prechamber 13, the whole being such that the intake valve 10, at its maximum rise, practically fully penetrates this cavity and expels the burnt gases. Further, the intake pipe 11 is advantageously provided with a lip 33, immediately upstream of the seat 16 and on its lower part, adapted to progressively accelerate, by a nozzle effect, the fresh air entering the prechamber 13 upon the opening of the intake valve 10.

Again preferably, the fuel is introduced under pressure in the prechamber 13 through an injector 120 disposed, not at the top of this prechamber as diagrammatically shown in FIG. 1, but on the axis of the intake valve 17, which improves the homogeneity of the mixture of air and fuel admitted to the cylinder. In the case where two symmetrical intake valves 100 and 110 exist (FIG. 7), there may be provided only a single injector 120 which discharges along the axis of symmetry of the assembly of these two valves.

I claim:

1. A two-stroke internal combustion engine having a cylinder head (6), at least one cylinder (1) with a reciprocating piston (3), and a device in said cylinder head (6) for exchanging burnt gases with air and having a plane of symmetry containing an axis (2) of the cylinder (1), said device comprising a group of at least one intake valve (10) and a group of at least one exhaust valve (7), said intake valve having a seat (16) disposed in a wall of a scavenging and precombustion chamber (13), said device characterized in that the precombustion chamber (13) communicates with the cylinder (1) through a transfer passageway (14) having a wall (14*a*) at least partially substantially parallel to the axis of the cylinder (1) and whose cross-section perpendicular to said axis opens out to form a substantially oblong shape tangentially to a surface of said cylinder and, said intake valve (10) cooperates, practically without clearance (32), with an end wall part (18) of said precombustion chamber (13) which is in a substantially opposed relationship to said transfer passageway (14), and said device also characterized in that a portion of the wall of the precombustion chamber (13) in which the seat (16) associated with said intake valve (10) is located extends tangent to the surface of the cylinder (1).

2. An engine according to claim 1 characterized in that said device comprises a single intake valve (10) and a single exhaust valve (7).

3. An engine according to claim 1, characterized in that the device for exchanging said gases has two intake valves (100, 110) which are parallel to each other.

4. An engine according to claim 1, characterized in that the device for exchanging said gases has two exhaust valves (107, 117) parallel to the axis of the cylinder.

5. An engine according to claim 1, characterized in that a cross-section of the transfer passageway (14) where said transfer passageway opens onto the cylinder (1) is developed on a circular sector having an angle subtended at the centre of between 60° and 110° and represents an area the ratio of which to that of a cross-section of the cylinder (1) is between 0.10 and 0.20.

6. An engine according to claim 1, characterized in that the end wall part (18) of said precombustion chamber (13) is constituted by a cylindrical portion of revolution (30) coaxial with said intake valve (10) and substantially tangent to an associated valve head so that a radial clearance (32) between said end wall part (30) and a head of said intake valve (10) has a minimum value which is such that said intake valve (10) discharges directly and essentially on a sector thereof oriented in towards the transfer passageway (14) so as to orient the quasi-totality of an air flow issuing from said intake valve (10) directly toward the transfer passageway (14).

7. An engine according to claim 1, characterized in that each group of at least one intake valve and each group of at least one exhaust valve are controlled by a single common overhead camshaft.

8. An engine according to claim 1, characterized in that a ratio between a maximum rise of said intake vale (10) and an inside diameter of a seat (16) of said intake valve is greater than 0.35.

9. An engine according to claim 1, characterized in that a head (10*a*) of said intake valve (10) cooperates, by its surface (21) remote from its seat (16), with a cavity (30) of conjugate shape provided in an opposed wall part of said precombustion chamber (13).

10. An engine according to claim 1, characterized in that the seat (16) of said intake valve (10) is flat and tangent both to the wall of the transfer passageway (14) and the surface of said cylinder (1).

11. An engine according to claim 1, characterized in that an intake pipe (11) for said intake valve is provided with a lip (33) immediately upstream of the seat (16) of said intake valve and on a part of said pipe (11) closest to said transfer passageway.

12. An engine according to claim 2, characterized in that a fuel injector (120) opens onto the precombustion chamber (13) approximately on an axis of said intake valve (10) and on a side of said precombustion chamber opposite to said intake valve.

13. An engine according to claim 1 wherein a stem of said intake valve is located completely outside of an extension of the cylinder when said intake valve is closed.

14. A two-stroke internal combustion engine having a cylinder head (6), at least one cylinder (1) with a reciprocating piston (3), and a device in said cylinder head (6) for exchanging burnt gases with air and having a plane of symmetry containing an axis (2) of the cylinder (1), said device comprising a group of at least one intake valve (10) and a group of at least one exhaust valve (7), said intake valve having a seat (16) disposed in a wall of a scavenging and precombustion chamber (13), said device characterized in that the precombustion chamber (13) communicates with the cylinder (1) through a transfer passageway (14) having a wall (14*a*) at least partially substantially parallel to the axis of the cylinder (1) and whose cross-section perpendicular to said axis opens out to form a substantially oblong shape tangentially to a surface of said cylinder and, said intake valve (10) cooperates, practically without clearance (32), with an end wall part (18) of said precombustion chamber (13) which is in a substantially opposed relationship to said transfer passageway (14), and said device also characterized in that a cross-section of the transfer passageway (14) where said transfer passageway opens onto the cylinder (1) is developed on a circular sector having an angle subtended at the centre of between 60° and 110° and represents an area the ratio of which to that of a cross-section of the cylinder (1) is between 0.10 and 0.20.

15. An engine according to claim 14, characterized in that an axis of each said intake valve (10) has a direction which is not parallel to the axis (2) of the cylinder (1) and makes with the latter axis and angle of between about 45° and 90°.

16. A device provided in a cylinder head of a two-stroke engine and associated with a cylinder and piston of the engine for exchanging burnt gases with air, said device comprising a group of at least one intake valve (10) and a group of at least one exhaust valve (7), said intake valve having a seat (16) disposed in a wall of a scavenging and precombustion chamber (13), said device having a plane of symmetry containing an axis of the cylinder, said device characterized in that the precombustion chamber (13) communicates with the cylinder (1) through a transfer passageway (14) having a wall (14*a*) at least partially substantially parallel to the axis of the cylinder (1) and whose cross-section perpendicular to said axis opens out to form a substantially oblong shape tangentially to a surface of aid cylinder and, said intake valve (10) cooperates, practically without clearance (32), with an end wall part (18) of said precombustion chamber (13) which is in a substantially opposed relationship to said transfer passageway (14), and said device also characterized in that a portion of the wall of the precombustion chamber (13) in which the seat (16) associated with said intake valve (10) is located extends tangent to the surface of the cylinder (1).

17. An engine according to claim 16, characterized in that a cross-section of the transfer passageway (14) where said transfer passageway opens onto the cylinder (1) is developed on a circular sector having an angle subtended at the centre of between 60° and 110° and represents an area the ratio of which to that of a cross-section of the cylinder (1) is between 0.10 and 0.20.

18. An engine according to claim 16, characterized in that the end wall part (18) of said precombustion chamber (13) is constituted by a cylindrical portion of revolution (30) coaxial with said intake valve (10) and substantially tangent to an associated valve head so that a radial clearance (32) between said end wall part (30) and a head of said intake valve (10) has a minimum value which is such that said intake valve (10) discharges directly and essentially on a sector thereof oriented in towards the transfer passageway (14) so as to orient the quasi-totality of an air flow issuing from said intake valve (10) directly toward the transfer passageway (14).

19. An engine according to claim 16, characterized in that a ratio between a maximum rise of said intake valve (10) and an inside diameter of a seat (16) of said intake valve is greater than 0.35.

20. An engine according to claim 16, characterized in that a head (10*a*) of said intake valve (10) cooperates, by its surface (21) remote form its seat (16), with a cavity (30) of conjugate shape provided in an opposed wall part of said precombustion chamber (13).

21. An engine according to claim 16, characterized in that the seat (16) of said intake valve (10) is flat and tangent both to the wall of the transfer passageway (14) and the surface of said cylinder (1).

22. An engine according to claim 16, characterized in that an intake pipe (11) for said intake valve is provided with a lip (33) immediately upstream of the seat (16) of said intake valve and on a part of said pipe (11) closest to said transfer passageway.

23. An engine according to claim 16, characterized in that a fuel injector (120) opens onto the precombustion camber (13) approximately on an axis of said intake valve (10) and on a side, of said precombustion chamber opposite to said intake valve.

24. An engine according to claim 16 wherein a stem of said intake valve is located completely outside of an extension of the cylinder when said intake valve is closed.

* * * * *